US005667646A

United States Patent [19]

Tomotaki

[11] Patent Number: 5,667,646

[45] Date of Patent: Sep. 16, 1997

[54] DRESSING APPARATUS

[75] Inventor: Katsura Tomotaki, Narashino, Japan

[73] Assignee: Seiko Seiki Kabushiki Kaisha, Japan

[21] Appl. No.: 631,312

[22] Filed: Apr. 10, 1996

[30] Foreign Application Priority Data

May 11, 1995 [JP] Japan ..... 7-112841

[51] Int. Cl.[6] ..... B23H 11/00; B23H 3/00

[52] U.S. Cl. ..... 204/217; 204/224 M; 204/225

[58] Field of Search ..... 204/224 M, 212, 204/217, 225; 205/663–664

[56] References Cited

U.S. PATENT DOCUMENTS 3,285,843 11/1966 Blake ..... 204/224 M 4,236,985 12/1980 Grodzinsky et al. ..... 205/663 X 4,849,599 7/1989 Kuromatsu ..... 204/212 X 5,108,561 4/1992 Kuromatsu ..... 205/663

5,194,126 3/1993 Packalin ..... 205/663

*Primary Examiner*—Donald R. Valentine

*Attorney, Agent, or Firm*—Adams & Wilks

[57] ABSTRACT

A dressing apparatus comprises at least two electrode pieces each having an arcuate inner surface and being arranged around a grinding stone to define a gap therebetween. A gap adjusting mechanism adjusts the gap between the arcuate inner surface of each of the electrodes and the grinding stone and maintains the gap between the arcuate inner surface of each electrode and the grinding stone equal to each other.

17 Claims, 8 Drawing Sheets

FIG. 9

| NUMBER of SPLIT ELECTRODES | 2 | | 3 | | 2 | | 3 | |
|---|---|---|---|---|---|---|---|---|
| ELECTRODE DIAMETER (mm) | ϕ 150 | | ϕ 150 | | ϕ 146 | | ϕ 146 | |
| GRINDING STONE DIAMETER (mm) | ϕ 150 | ϕ 146 | ϕ 150 | ϕ 146 | ϕ 150 | ϕ 146 | ϕ 150 | ϕ 146 |
| MINIMUM GAP (SET GAP) (mm) | 0.30 | | 0.30 | | 0.30 | | 0.30 | |
| MAXIMUM GAP (mm) | 0.30 | 0.43 | 0.30 | 0.36 | 0.50 | 0.30 | 0.38 | 0.30 |

FIG. 12

PRIOR ART (mm)

| ELECTRODE DIAMETER | ϕ 150 | | ϕ 146 | |
|---|---|---|---|---|
| GRINDING STONE DIAMETER | ϕ 150 | ϕ 146 | ϕ 150 | ϕ 146 |
| MINIMUM GAP (SET GAP) | 0.30 | | 0.30 | |
| MAXIMUM GAP | 0.30 | 0.79 | 1.30 | 0.30 |

DRESSING APPARATUS

1. BACKGROUND OF THE INVENTION

The present invention relates to a dressing apparatus for performing in-process electrolytic dressing on a grinding stone which is engaged in a process.

Conventionally, when a process is performed using a grinding stone made from a conductive base material, the so-called electrolytic in-process dressing is performed, i.e., the grinding stone is subjected to in-process electrolytic dressing during the ongoing process for purposes such as preventing the grinding stone from causing clogging (hereinafter referred to as "ELID grinding").

As shown in FIG. 10, ELID grinding is a process of performing electrolytic dressing on a grinding stone 1 by applying electricity to a grinding fluid filled between a grinding stone 1 and an electrode 2 having an arcuate inner surface to cause electrolysis which elutes the base material of the grinding stone 1.

In the above-described process, the grinding stone 1 and the electrode 2 are set as positive and negative poles, respectively, and a grinding fluid having low conductivity is used and supplied to the gap between the grinding stone 1 and the electrode 2 through a nozzle which is not shown.

In summary, in ELID grinding, an appropriate amount of base material of the grinding stone 1 is eluted by means of anodization to keep the amount of the abrasive grains that are projected constant.

During such conventional ELID grinding, as the grinding stone 1 is worn as the processing on the workpiece using the grinding stone 1 proceeds, the gap between the electrode 2 and the grinding stone 1 is expanded accordingly. This results in a need for sliding the electrode 2 toward the grinding stone 1 (in the direction indicated by the arrow A in FIG. 10) repeatedly to adjust the gap.

However, if the grinding stone 1 becomes smaller as shown in FIG. 11 as a result of wear, there will be a difference between the curvature of the outer circumference of the grinding stone 1 and the curvature of the inner arc of the electrode 2. This results in a similar variation in the width of the gap between the grinding stone 1 and the electrode 2. In particular this gap is maximized at the side of ends 2*a* of the electrode 2.

For example, in the case of an electrode of 90° as shown in FIG. 12 wherein the diameter of the grinding stone, the diameter of the electrode, and the gap between the grinding stone and the electrode are set at 150 mm, 150 mm; and 0.3 mm, respectively, the gap between the grinding stone and the electrode is expanded to a maximum of 0.79 mm when the grinding stone is worn to a diameter of 146 mm.

As a result of such expansion of the gap, the area of the electrode 4 effective for ELID grinding is reduced; initial efficient dressing can not be maintained; a non-conductor film having a sufficient thickness can not be produced in the area where the base material is eluted; and the stability of the ELID grinding can not be maintained.

Further, in conventional ELID grinding, dressing conditions significantly vary depending on the diameter of the grinding stone even if a brand-new grinding stone is used. Specifically, if conventional ELID grinding is applied to a grinding stone having a small diameter which is different from the grinding stone 1, the width of the gap between the grinding stone of a small diameter and the electrode 2 will fluctuate for reasons associated with the curvature of the inner arc of the electrode. This reduces the area of the electrode 2 effective for ELID grinding and results in significant changes in dressing conditions. As a result, a problem arises in that initial efficient dressing can not be maintained and in that only a limited range of grinding stones can be used.

SUMMARY OF THE INVENTION

It is an object of the present invention to provide a dressing apparatus which is suitable for continued dressing with initial efficiency maintained.

In order to achieve the above-mentioned object, in a dressing apparatus which performs electrolytic dressing on a grinding stone by applying electricity to a grinding fluid filled between a grinding stone and an electrode having an arcuate inner surface to cause electrolysis which elutes the base material of the grinding stone, according to the present invention, the electrode is split into at least two pieces; those split electrodes are arranged around the grinding stone adjacent to each other; and a gap adjusting means is provided to adjust the gap between each of the split electrodes and the grinding stone.

Further, the gap adjusting means comprises guide portions for guiding the slide of the split electrodes toward the grinding stone and adjusting portions separately provided for each of the split electrodes for adjusting the amount of the slide of the split electrodes.

Further, the gap adjusting means comprises guide portions for guiding the slide of the split electrodes toward the grinding stone, an adjusting portion provided at any one of the split electrodes for adjusting the amount of the slide of the split electrodes and an interlocking means for interlocking the slide of the one of the electrodes and other electrodes.

In addition, the adjusting portion comprises support elements disposed so as to face the grinding stone with the split electrodes interposed therebetween, female screw portions formed on the split electrodes in positions facing the support elements, and adjustment screws rotatably attached to the support elements for engagement with the female screw portions.

Furthermore, the adjusting portion comprises cam mechanisms for sliding the split electrodes by means of the rotation of cams in contact with the split electrodes.

The present invention makes it possible to adjust the electrode gap in at least two independent adjusting directions by sliding each of the split electrodes.

BRIEF DESCRIPTION OF THE DRAWINGS

FIG. 9 illustrates an example of the result of gap adjustment according to the present invention;

FIG. 12 illustrates an example of the result of gap adjustment in a conventional dressing apparatus.

DETAILED DESCRIPTION OF THE PREFERRED EMBODIMENTS

Preferred embodiments of a dressing apparatus according to the present invention will now be described in detail with reference to FIGS. 1 through 9.

Figure 1:
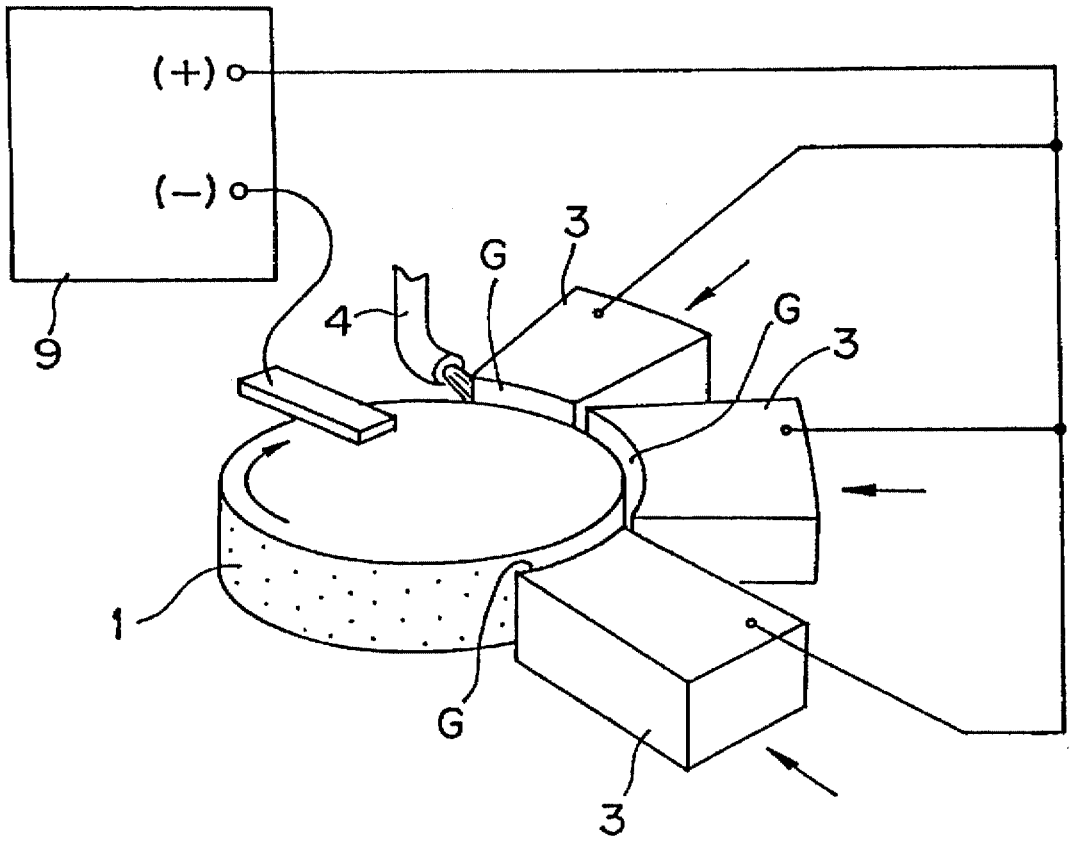
FIG. 1 is a schematic perspective view of an embodiment of the present invention.

The dressing apparatus shown in FIG. 1 includes three split electrodes 3 facing an abrasive surface at the outer circumference of a grinding stone 1. Those split electrodes 3 are arranged around the grinding stone 1 adjacent to each other.

Figure 10:
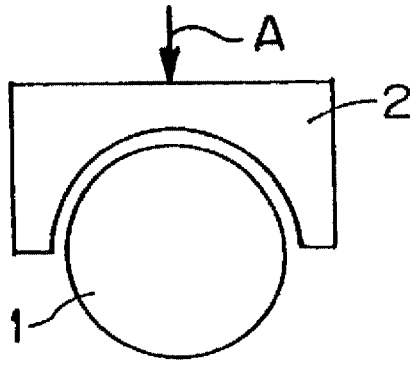
FIG. 10 PRIOR ART
FIG. 10 is a plan view showing a conventional dressing apparatus.
Figure 11:
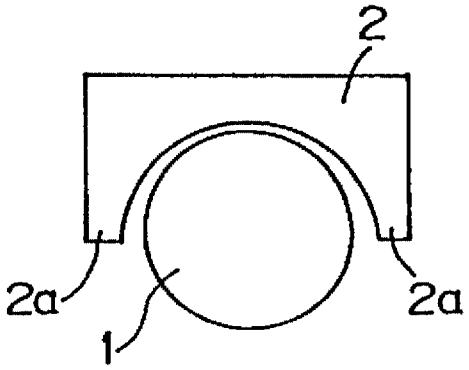
FIG. 11 PRIOR ART
FIG. 11 illustrates gap adjustment in a conventional dressing apparatus.

Such split electrodes 3 are obtained by splitting an electrode which has conventionally been a single element (see 2 in FIG. 10) into three pieces and by arranging them radially about the grinding stone 1. All of those electrodes are formed to have an arcuate surface facing the grinding stone 1.

The split electrodes 3 are all set as a negative pole and the grinding stone 1 is set as a positive pole. Predetermined gaps G are provided between the grinding stone 1 and the respective split electrodes 3, and a grinding fluid having low conductivity is supplied to the gaps G from a nozzle 4.

Figure 2:
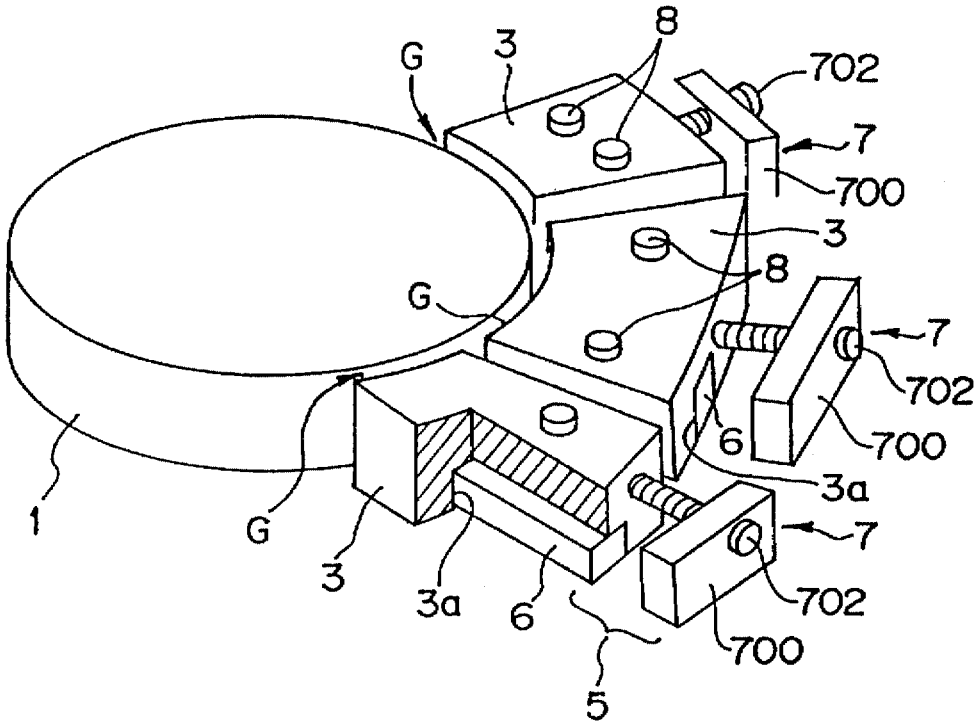
FIG. 2 is a perspective view showing a gap adjusting means of a dressing apparatus according to the present invention.

As shown in FIG. 2, a gap adjusting means 5 is provided on the split electrodes 3. This gap adjusting means 5 is provided for adjusting the gaps G between the split electrodes 3 and the grinding stone 1 and is constituted by guide portions 6 and adjusting portions 7.

A guide portion 6 comprises a rail extending toward the center of the grinding stone 1 and slidably engages with a groove 3*a* on the bottom of a split electrode 3 to guide the slide of the split electrode 3 toward the grinding stone 1.

Figure 3:
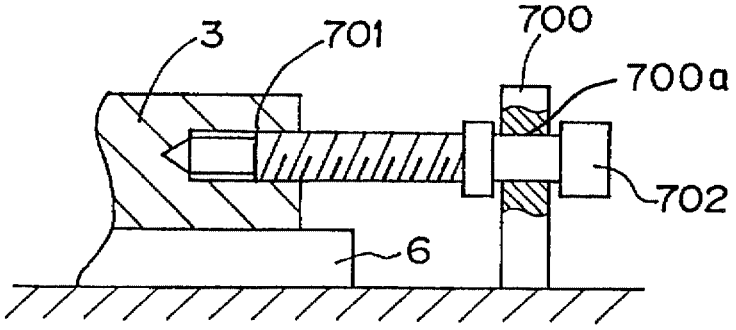
FIG. 3 is a partial sectional view of a gap adjusting means of a dressing apparatus according to the present invention.
Figure 4:
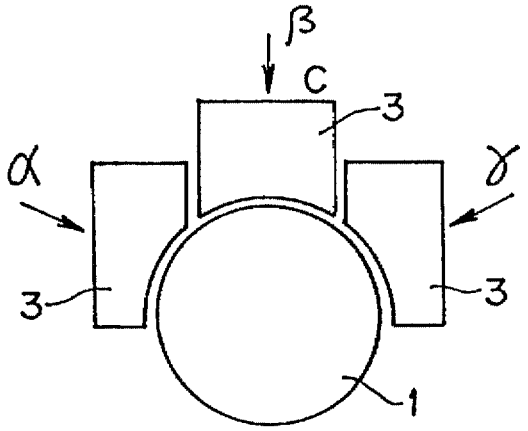
FIG. 4 illustrates the operation of the apparatus of the embodiment shown in FIG. 1.

An adjusting portion 7 is separately provided for each of the split electrodes 3 and is constituted by a support element 700, a female screw portion 701, and an adjustment screw 702 (see FIG. 3).

The support element 700 is disposed so as to face the grinding stone 1 with the split electrode 3 interposed therebetween. The female screw portion 701 is formed on the split electrode 3 in a position facing the support element 700. The adjustment screw 702 engages with the female screw portion 701 and is rotatably inserted into a through hole 700*a* in the support element 700.

With this adjusting portion 7, since an operation on an adjustment screw 702 allows the split electrode 3 to slide in accordance with the rotation, amount of the slide of the split electrode 3 can be adjusted based on the amount of the rotation of the adjustment screw 702. This makes it possible to set the gap between the split electrode 3 and the grinding stone 1 at a desired value.

Fixing bolts 8 are provided on the split electrodes 3 for fixing the split electrode 3, thereby preventing it from sliding.

The operation of a dressing apparatus having the above-described configuration will now be described with reference to FIGS. 1 through 4.

In this dressing apparatus, energization occurs in the gaps between the grinding stone 1 and the split electrodes 3 when a power supply 9 is turned on with the gaps filled with a grinding fluid; the base material of the grinding stone 1 is eluted as a result of electrolysis caused by the energization; and the grinding stone 1 is thus subjected to electrolytic dressing.

The electrolytic dressing is performed on an in-process basis during a process on a workpiece using the grinding stone 1. As the process using the grinding stone 1 proceeds, the grinding stone 1 becomes smaller as a result of wear, which expands the gaps G between the grinding stone 1 and the split electrodes 3. Then, the adjustment screws 702 are operated to slide the split electrodes 3 toward the grinding stone 1 to adjust the gaps G between the split electrodes 3 and the grinding stone 1 separately in three directions (directions indicated by the arrows α, β, and γ).

Since all split electrodes 3 can be made closer to the grinding stone 1, the initial setting can be recovered wherein the gap G between the central split electrode 3 and the grinding stone 1 and the gaps G between the left and right split electrodes 3 and the grinding stone 1 are all equal.

In summary, in the dressing apparatus of the above-described embodiment, the electrode which has conventionally been a single element is split into three pieces, and those split electrodes 3 are arranged around the grinding stone 1 adjacent to each other. This allows the gaps G between the grinding stone 1 and the electrodes to be adjusted in three directions separately. Therefore, even if the grinding stone 1 becomes smaller as a result of wear or dressing being performed on a grinding stone having smaller diameter different from the grinding stone 1, differences in width between the gaps G can be made smaller than in the prior art to prevent the decrease in the electrode area effective for ELID grinding. This makes it possible to maintain initial efficient dressing and to produce a non-conductor film having a sufficient thickness in the area where the base material is eluted, thereby improving the stability of ELID grinding.

Although the above-described adjusting means 5 allows the adjustment of the gaps between the grinding stone 1 and the split electrodes 3 to be performed separately for each of the split electrodes 3, such adjustment of each split electrode may be performed simultaneously. To perform such simultaneous adjustment, a configuration may be employed wherein the slide of any one of the split electrodes is interlocked with the slide of other electrodes. For example, a gap adjusting means 5 as shown in FIG. 5 may be employed.

Figure 5:
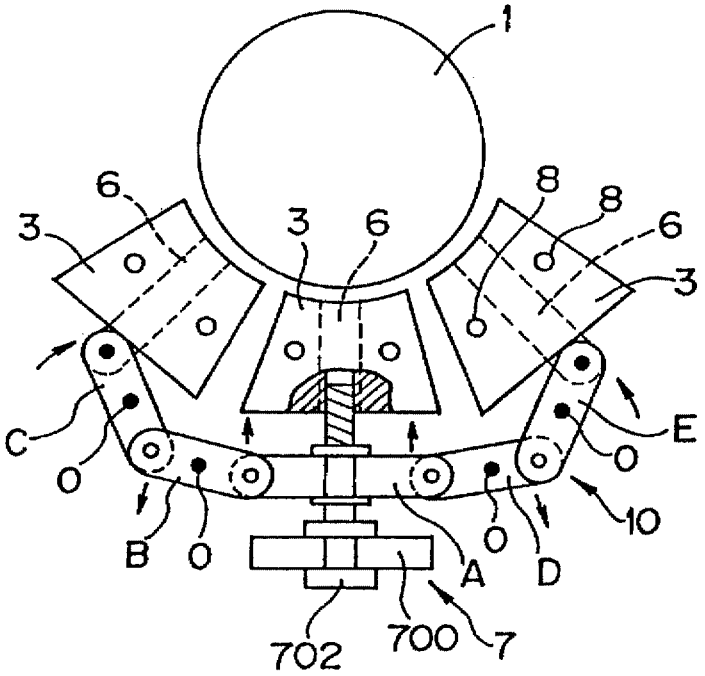
FIG. 5 is a plan view showing an embodiment of a gap adjusting means according to the present invention.

The gap adjusting means 5 shown in FIG. 5 includes guide portions 6, an adjusting portion 7, and a link mechanism 10 as an interlocking means. The adjusting portion 7 is not provided for left and right split electrodes 3 but for a split electrode 3 in the middle (see FIG. 5 and FIG. 6). The specific configuration of the adjusting portion 7 and the guide portions 6 is the same as in the above-described embodiment and therefore will not be described here.

The link mechanism 10 links the split electrodes 3 using links A–E and interlocks the slide of the central split electrode 3 with the slide of the left and right split electrodes 3.

Specifically, when the adjusting portion 7 is operated to move an adjustment screw 702 back and forth, the central split electrode 3 is slid in the same direction, which causes the links B–E to rotate simultaneously about respective supporting points O. As a result, the back-and-forth movement of the adjustment screw 702 is transferred to the left and right split electrodes 3 via the links A–E, causing the left and right split electrode 3 to slide in conjunction with the central split electrode 3 in the same direction. This slide allows simultaneous adjustment of the gaps between the grinding stone 1 and the split electrodes 3.

Figure 6:
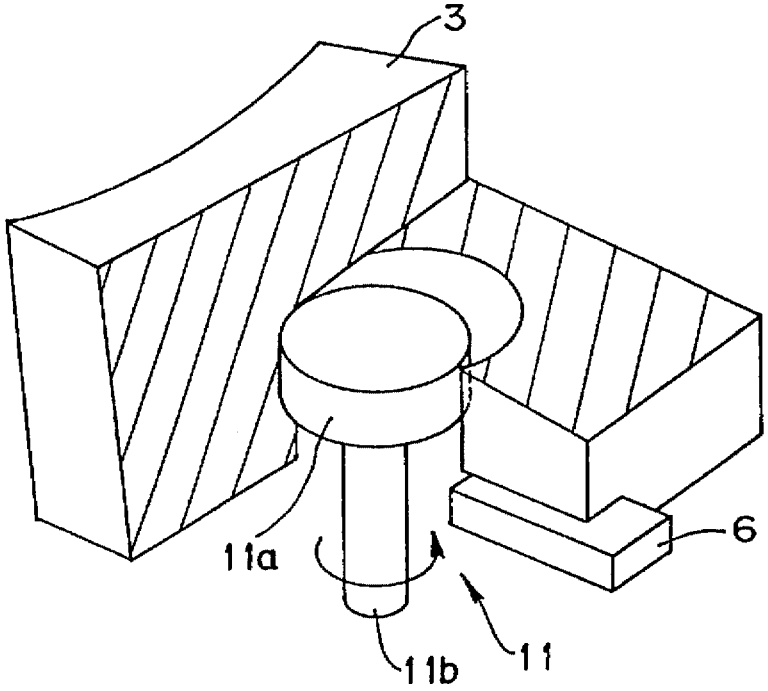
FIG. 6 is a perspective view showing an embodiment of an adjusting portion according to the present invention.
Figure 7:
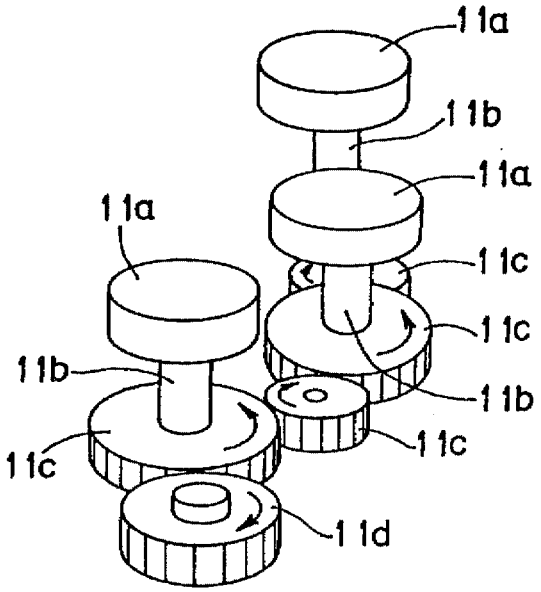
FIG. 7 is a perspective view showing another embodiment of an adjusting portion according to the present invention.

A cam mechanism 11 having the configuration as shown in FIG. 6 may be used for the adjusting portion 7. The cam mechanism 11 shown in FIG. 6 drives a split electrode 3 as a follower and includes a cam 11*a* provided in contact with the split electrode. The cam 11*a* eccentrically rotates about a rotational axis 11*b* integral therewith, which causes the split electrode 3 to slide. In such a manner, the gap between the grinding stone 1 and each of the split electrode 3 is adjusted.

The adjusting portions 7 of all of the split electrodes 3 can be configured using cam mechanisms 11 as described above by linking the cams 11*a* using a plurality of toothed wheels 11*c* and by providing an adjusting knob 11*d* which engages with one of the toothed wheels 11*c* (see FIG. 1).

When the cams 11*a* are linked using such an interlocking means consisting of a plurality of toothed wheels, all of the cams 11*a* can be rotated in conjunction with each other by simply turning the adjusting knob 11*d*. Therefore, gap adjustment can be simultaneously performed for the split electrodes 3 as in the case wherein the split electrodes 3 are linked using links A–E as described above.

Figure 8:
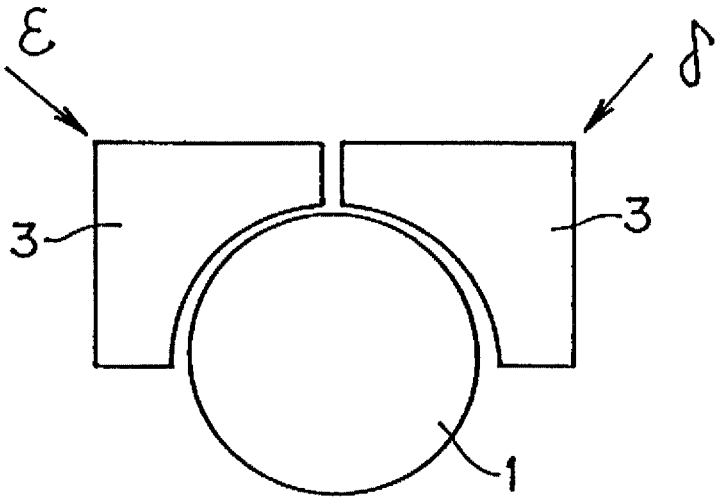
FIG. 8 illustrates the operation of another embodiment of the present invention.

Although the electrode is split into three pieces in the above-described embodiments unlike the prior art wherein the electrode is a single element, the present invention is not limited to this number and the electrode may be split into three or more pieces or into two pieces as shown in FIG. 8.

The adjusting screw 702 may be manually operated or may be operated using a servo motor, stepping motor, or the like. Alternatively, the adjustment may be performed by attaching a motor as described above to each of three separate adjustment screws and by operating the motors using independent drivers or a single driver.

A specific advantage of the present invention will now be described with reference to FIG. 9 and FIG. 12. Let us assume that the diameter of the grinding stone is reduced to 146 mm as a result of wear in an apparatus wherein the grinding stone diameter, the electrode diameter, and the gap between the grinding stone and the electrode have been set at 150 mm, 150 mm, and 0.3 mm, respectively. Then, the gap between the grinding stone and the electrode is expanded to a maximum of 0.79 mm in the prior art as shown in FIG. 12. In the embodiments, however, the maximum expansion is only 0.43 mm and 0.36 mm for two split electrodes and three split electrodes, respectively, as shown in FIG. 9. That is, the maximum gap can be reduced to 50–40% of that in the prior art in the case of two split electrodes and, further, to 20–40% in the case of three split electrodes.

Further, let us assume that the electrode diameter is set at 146 mm in advance considering the wear of the grinding stone so that the gap between the grinding stone and the electrode becomes 0.3 mm when the grinding stone is worn. In this case, the initial maximum gap is 1.3 mm in the prior art as shown in FIG. 12 which is 60% greater than 0.79 mm which is reached when the grinding stone is worn with the electrode diameter set at 150 mm as described above. On the other hand, according to the present invention, the initial maximum gap is 0.5 mm and 0.38 mm for two split electrodes and three split electrodes, respectively, as shown in FIG. 9. There is expansion by only 16% and 6% for two split electrodes and three split electrodes, respectively, from the case wherein the grinding stone is worn with the electrode diameter set at 150 mm.

As described above, the maximum gap can be reduced from that in the prior art even with two split electrodes unlike the prior art wherein the electrode is a single element. Thus, the same advantage as in the case of three split electrodes in the above-described embodiment can be achieved. The reason for the fact that the maximum gap can be reduced even for two split electrodes is that the gap between the grinding stone 1 and them can be adjusted separately in two directions (directions indicated by the arrows $\delta$ and $\epsilon$ in FIG. 8).

In a dressing apparatus according to the present invention, the electrode is split into at least two pieces unlike the prior art wherein the electrode is a single element, and those split electrodes are arranged around the grinding stone adjacent to each other. This allows the electrode gap to be adjusted separately in two or more adjusting directions. Therefore, when the grinding stone becomes smaller as a result of wear or when dressing is performed on a grinding stone having a smaller diameter different from the grinding stone, variation in the width of the gap can be made smaller than in the prior art to prevent electrode area effective for ELID grinding from being reduced. This makes it possible to maintain initial efficient dressing and to produce a non-conductor film having a sufficient thickness in the area where the base material is eluted, thereby improving the stability of ELID grinding.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of the present invention.

What is claimed is:

1. A dressing apparatus which performs electrolytic dressing on a circular grinding stone by applying electricity to a grinding fluid supplied between the grinding stone and an electrode having an arcuate inner surface to cause electrolysis which elutes the base material of the grinding stone, the dressing apparatus comprising: two or more electrode pieces each having an arcuate inner surface and being arranged around a grinding stone to define a gap therebetween; and gap adjusting means for adjusting the gap between the arcuate inner surface of each electrode piece and a surface of the grinding stone and for maintaining the gap between the arcuate inner surface of each electrode piece and a surface of the grinding stone equal to each other.

2. A dressing apparatus according to claim 1; wherein the gap adjusting means comprises a guide portion for guiding a sliding movement of the electrode pieces toward the grinding stone, and an adjusting portion separately provided for each of the electrode pieces for adjusting the amount of the sliding movement of the electrode pieces.

3. A dressing apparatus according to claim 1; wherein the gap adjusting means comprises a guide portion for guiding a sliding movement of the electrode pieces toward the grinding stone, an adjusting portion provided at a first one of the electrode pieces for adjusting the amount of the sliding movement of the electrode pieces, and interlocking means for interlocking the sliding movement of the first electrode piece with the sliding movement of the other electrode pieces.

4. A dressing apparatus according to claim 2 or claim 3; wherein the adjusting portion comprises a support element disposed so as to face the grinding stone with one of the electrode pieces interposed therebetween, a female screw portion formed on the one electrode piece in a position facing the support element, and an adjustment screw rotatably attached to the support element for engagement with the female screw portion.

5. A dressing apparatus which performs electrolytic dressing on a grinding stone by applying electricity to a grinding fluid supplied between the grinding stone and an electrode having an arcuate inner surface to cause electrolysis which elutes the base material of the grinding stone, the dressing apparatus comprising: two or more electrode pieces each arranged around a grinding stone to define a gap therebetween; and gap adjusting means for adjusting the gap between each of the electrode pieces and the grinding stone, the gap adjusting means including a guide for guiding a sliding movement of the electrode pieces toward the grinding stone, and an adjusting portion separately provided for each of the electrode pieces for adjusting the amount of the sliding movement of the electrode pieces, the adjusting portion including a cam mechanism for sliding the electrode piece in response to rotation of a cam in contact with the electrode piece.

6. A dressing apparatus which performs electrolytic dressing on a grinding stone by applying electricity to a grinding fluid supplied between the grinding stone and an electrode having an arcuate inner surface to cause electrolysis which elutes the base material of the grinding stone, the dressing apparatus comprising: two or more electrode pieces each arranged around the grinding stone to define a gap therebetween; and gap adjusting means for adjusting the gap between each of the electrode pieces and the grinding stone, the gap adjusting means including a guide for guiding a sliding movement of the electrode pieces toward the grinding stone, an adjusting portion provided at a first one of the electrode pieces for adjusting the amount of the sliding movement of the electrode pieces, and interlocking means for interlocking the sliding movement of the first electrode piece with the sliding movement of the other electrode pieces, the adjusting portion including a cam mechanism for sliding the electrode piece in response to rotation of a cam in contact with the electrode piece.

7. A dressing apparatus for performing electrolytic dressing on a grinding stone, comprising: a plurality of electrodes each having a surface facing and spaced apart from a peripheral surface of a grinding stone to define a gap therebetween; and a gap adjusting mechanism for adjusting the gap between the surface of each of the electrodes and the peripheral surface of the grinding stone and for maintaining the gaps equal.

8. A dressing apparatus according to claim 7; wherein the gap adjusting mechanism comprises an adjusting portion separately provided for each of the electrodes for adjusting the gap between the surface of the electrode and the peripheral surface of the grinding stone.

9. A dressing apparatus according to claim 8; wherein the adjusting portion for each electrode comprises a support element facing the peripheral surface of the grinding stone and spaced apart therefrom with the electrode disposed therebetween, a threaded bore disposed in the electrode, and a threaded member rotatably engaged with the support element for threaded engagement with the threaded bore of the electrode.

10. A dressing apparatus according to claim 7; wherein the gap adjusting mechanism comprises an adjusting portion for simultaneously adjusting the gap between the surface of each of the electrodes and the peripheral surface of the grinding stone.

11. A dressing apparatus according to claim 10; wherein the adjusting portion is connected to one of the electrodes; and further comprising a linkage mechanism for pivotally connecting the adjusting portion to the other electrodes which are not connected to the adjusting portion.

12. A dressing apparatus according to claim 10; wherein the adjusting portion comprises a cam mechanism.

13. A dressing apparatus according to claim 7; wherein the gap adjusting mechanism comprises a plurality of rotatable cams each in contact with one of the electrodes, and means for rotating each of the cams to adjust the gap between the surface of each of the electrodes and the peripheral surface of the grinding stone.

14. A dressing apparatus according to claim 7; wherein the gap adjusting mechanism comprises a guide for guiding a sliding movement of each of the electrodes toward the grinding stone, and an adjusting portion separately provided for each of the electrodes for independently adjusting the amount of the sliding movement of each of the electrodes.

15. A dressing apparatus according to claim 14; wherein the adjusting portion for each electrode comprises a support element facing the peripheral surface of the grinding stone and spaced apart therefrom with the electrode disposed therebetween, a threaded bore disposed in the electrode, and a threaded member rotatably engaged with the support element for threaded engagement with the threaded bore of the electrode.

16. A dressing apparatus according to claim 7; wherein the gap adjusting mechanism comprises a guide for guiding a sliding movement of each of the electrodes toward the grinding stone, and an adjusting portion for simultaneously adjusting the amount of the sliding movement of the electrodes.

17. A dressing apparatus according to claim 16; wherein the adjusting portion for each electrode comprises a support element facing the peripheral surface of the grinding stone and spaced apart therefrom with the electrode disposed therebetween, a threaded bore disposed in the electrode, and a threaded member rotatably engaged with the support element for threaded engagement with the threaded bore of the electrode.

* * * * *